US008250872B2

(12) United States Patent
Takaoka et al.

(10) Patent No.: US 8,250,872 B2
(45) Date of Patent: Aug. 28, 2012

(54) REFRIGERATING APPARATUS CONTROL CIRCUIT, REFRIGERATING SYSTEM, AND REFRIGERATING APPARATUS CONTROL METHOD

(75) Inventors: Hisaaki Takaoka, Osaka (JP); Susumu Matsui, Osaka (JP); Kiichirou Satou, Osaka (JP); Shuuhei Yamaguchi, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 650 days.

(21) Appl. No.: 12/517,340

(22) PCT Filed: Dec. 18, 2007

(86) PCT No.: PCT/JP2007/074327

§ 371 (c)(1),
(2), (4) Date: Jun. 2, 2009

(87) PCT Pub. No.: WO2008/075687

PCT Pub. Date: Jun. 26, 2008

(65) Prior Publication Data

US 2010/0070081 A1 Mar. 18, 2010

(30) Foreign Application Priority Data

Dec. 19, 2006 (JP) ..... 2006-340757
Dec. 7, 2007 (JP) ..... 2007-317163

(51) Int. Cl.
*F25B 49/00* (2006.01)

(52) U.S. Cl. ..... 62/132; 62/157; 700/276

(58) Field of Classification Search ..... 62/126, 62/132, 1, 157, 231; 700/276
See application file for complete search history.

(56) References Cited

U.S. PATENT DOCUMENTS

| | | | | |
|---|---|---|---|---|
| 5,969,606 | A * | 10/1999 | Reber et al. | 340/540 |
| 6,601,394 | B2 * | 8/2003 | Tatter | 62/127 |
| 7,065,501 | B1 * | 6/2006 | Brown et al. | 705/28 |
| 7,673,464 | B2 * | 3/2010 | Bodin et al. | 62/127 |

FOREIGN PATENT DOCUMENTS

| | | | |
|---|---|---|---|
| EP | 0 631 210 | | 12/1994 |
| JP | 2001-235270 | A | 8/2001 |
| JP | 2001-325205 | A | 11/2001 |
| JP | 2002-293433 | A | 10/2002 |
| JP | 2004-76950 | A | 3/2004 |
| JP | 2004-251508 | A | 9/2004 |
| JP | 2004-271051 | A | 9/2004 |
| JP | 2005-83602 | A | 3/2005 |
| JP | 2005-83605 | A | 3/2005 |
| WO | 00/52546 | | 9/2000 |
| WO | 01/48431 | | 7/2001 |

* cited by examiner

*Primary Examiner* — Marc Norman
(74) *Attorney, Agent, or Firm* — Birch, Stewart, Kolasch & Birch, LLP

(57) ABSTRACT

A refrigerating driving control section controls the driving of the refrigerating apparatus. A control constant storage section stores data in which information indicating the object to be refrigerated by the refrigerating apparatus and control constants that the refrigerating driving control section adopts for the object are associated together. An operation of operation section specifies the object. From the control constant storage section, the refrigerating driving control section reads the control constants corresponding to the object specified by the operation section, and the driving of the refrigerating apparatus is controlled on the basis of the read control constants.

17 Claims, 4 Drawing Sheets

REFRIGERATING APPARATUS CONTROL CIRCUIT, REFRIGERATING SYSTEM, AND REFRIGERATING APPARATUS CONTROL METHOD

TECHNICAL FIELD

The present invention relates to refrigerating apparatuses, and particularly to a technique for making temperature settings suitable for the object to be refrigerated.

BACKGROUND ART

A refrigerating apparatus, e.g. a refrigerated container, stores objects to be refrigerated. The temperature is then set suitably for the objects to be refrigerated. For such temperature settings, Patent Document 1, for example, proposes a technique for inputting data from outside into a control unit that controls a refrigerated container.

Patent Document 1: Japanese Patent Application Laid-Open No. 2001-325205

DISCLOSURE OF THE INVENTION

Problems to be Solved by the Invention

However, even when data is properly inputted, the refrigerating conditions in the refrigerating apparatus cannot be suitably set without technical knowledge sufficient to properly handle the data. For example, simply inputting temperature settings into a panel can be made without technical knowledge, but determining to what temperatures the settings should be made requires knowledge about the object to be refrigerated and about the control of the refrigerated container.

When various refrigerating conditions, including temperature settings, are wrong, the object to be refrigerated cannot be suitably refrigerated and its quality will deteriorate.

Considering such situations, an object of the present invention is to provide a technique for suitably refrigerating an object to be refrigerated by driving a refrigerating apparatus under suitable refrigerating conditions just by specifying the object to be refrigerated even when the user does not know detailed refrigerating conditions.

Means for Solving the Problems

A refrigerating apparatus control circuit according to the present invention comprises: a refrigerating driving control section (11) that controls driving of the refrigerating apparatus (3); a control constant storage section (12) that stores, for a plurality of objects, data (120) in which information (Li) indicating an object (4) to be refrigerated by said refrigerating apparatus (3) and a control constant (Ci, Di, Ei, . . . ) that said refrigerating driving control section adopts for that object are associated together; and an operation section (14) that is operated to specify said object. Said refrigerating driving control section (11) reads from said control constant storage section said control constant corresponding to said object specified by said operation section, and controls the driving of said refrigerating apparatus on the basis of read said control constant.

Desirably, in each said data, said control constant has first control constants (Ci1, Ci2, Ci3) determining a plurality of setting temperatures (F1, F2, F3), and second control constants (Ti1, Ti2, T13) determining a plurality of setting times ($\tau$1, $\tau$2, $\tau$3) that said setting temperatures should respectively last, and the driving of said refrigerating apparatus is controlled in correspondence with said object on the basis of said setting temperatures and said setting times.

Desirably, in each said data, a first (F1) of said plurality of setting temperatures is set in a chilled temperature zone, a second (F2) of said plurality of setting temperatures is set in a frozen temperature zone, and a third (F3) of said plurality of setting temperatures is set in a temperature zone that is suitable for transportation of said object to which that data corresponds.

Desirably, in each said data, said plurality of setting times are set corresponding to transportation of said object to which said data corresponds.

A refrigerating system according to the present invention comprises: the refrigerating apparatus control circuit (1) according to the present invention; and said refrigerating apparatus (3). Desirably, it further comprises a refrigerated container (2) containing said refrigerating apparatus (3).

A refrigerating apparatus control method according to the present invention comprises steps of: (a) displaying (S2) a plurality of objects (4) to be refrigerated by a refrigerating apparatus (3); (b) inputting (S3) to specify one of said objects; (c) reading (S4), from a control constant storage section (12), a control constant (Ci, Di, Ei, . . . ) that corresponds to said one of said objects specified in said step (b) and that is adopted to control driving of said refrigerating apparatus; and (d) controlling (S5) the driving of said refrigerating apparatus on the basis of said control constant read in said step (c).

Desirably, said control constant has first control constants (Ci1, Ci2, Ci3) determining a plurality of setting temperatures (F1, F2, F3), and second control constants (Ti1, Ti2, Ti3) determining a plurality of setting times ($\tau$1, $\tau$2, $\tau$3) that said setting temperatures should respectively last, and in said step (d), the driving of said refrigerating apparatus is controlled in correspondence with said object on the basis of said setting temperatures and said setting times.

Desirably, in each said data, a first (F1) of said plurality of setting temperatures is set in a chilled temperature zone, a second (F2) of said plurality of setting temperatures is set in a frozen temperature zone, and a third (F3) of said plurality of setting temperatures is set in a temperature zone that is suitable for transportation of said object to which that data corresponds.

Desirably, in each said data, said plurality of setting times are set corresponding to transportation of said object to which said data corresponds.

Desirably, the method further comprises a step of: (e) performed prior to said steps (a) to (d), storing in said control constant storage section (12), and for each said object (4), data (120) in which information (Li) indicating an object and a control constant (Ci, Di, Ei, . . . ) that said refrigerating driving control section adopts for that object are associated together.

Effects of the Invention

According to the refrigerating apparatus control circuit of the present invention, the refrigerating system using the same, and the refrigerating apparatus control method of the present invention, it is possible to suitably refrigerate an object to be refrigerated by driving a refrigerating apparatus under suitable refrigerating conditions just by specifying the object to be refrigerated even when the user does not know detailed refrigerating conditions.

These and other objects, features, aspects and advantages of the present invention will become more apparent from the following detailed description of the present invention when taken in conjunction with the accompanying drawings.

BEST MODE FOR CARRYING OUT THE INVENTION

Figure 1:
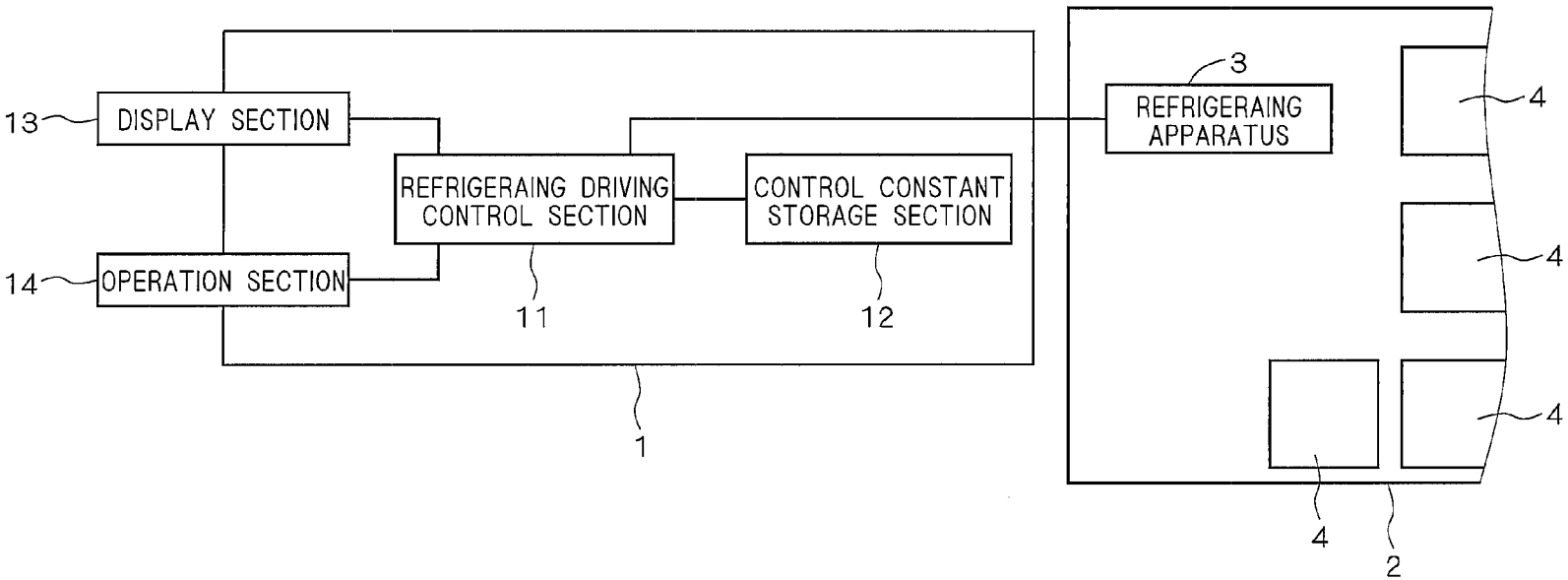
FIG. 1 is a block diagram illustrating the configuration of a refrigerating system according to one preferred embodiment of the present invention.

FIG. 1 is a block diagram illustrating the configuration of a refrigerating system according to one preferred embodiment of the present invention. This refrigerating system includes a refrigerating apparatus 3, a refrigerated container 2 that contains the refrigerating apparatus 3, and a control circuit 1 for controlling the refrigerating apparatus 3. The refrigerated container 2 stores objects 4 to be refrigerated by the refrigerating apparatus 3.

The control circuit 1 includes a refrigerating driving control section 11, a control constant storage section 12, a display section 13, and an operation section 14.

Figure 5:
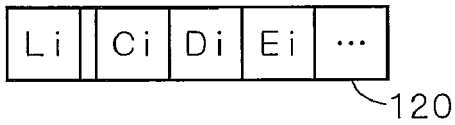
FIG. 5 is a diagram illustrating the structure of data stored in a control constant storage section.

The control constant storage section 12 stores data 120 having a structure as illustrated in FIG. 5. The data 120 contains information Li indicating an object 4 and control constants Ci, Di, Ei, . . . in association. The subscripts i represent a plurality of numerical values, which are positive integers, for example. That is, a plurality of multiple data 120 structured as illustrated in FIG. 5 are provided in correspondence with the kinds of the objects 4.

The refrigerating driving control section 11 reads control constants from data 120 from the control constant storage section 12, and controls the driving of the refrigerating apparatus 3 on the basis of the control constants. The control constants Ci, Di, Ei, . . . are values that are adopted by the refrigerating driving control section 11 for the object 4 indicated by the information Li, which determine the settings of temperature, the settings of humidity, the intervals of dehumidification, and the amount of ventilation, for example. These control constants are chosen depending on the performance of the entire refrigerating system, such as the ability of the refrigerating apparatus 3 and the size of the refrigerated container 2, and the kind of the object 4, e.g. whether the object 4 is apples, pineapples, or tuna. The control constants are stored in the control constant storage section 12 before the refrigerating process is conducted.

The display section 13 and the operation section 14 are provided such that they can be easily checked and operated from outside of the control circuit 1, and FIG. 1 shows such a condition by depicting the display section 13 and the operation section 14 sticking out of the control circuit 1. It is not always necessary to separately provide the display section 13 and the operation section 14 as shown in FIG. 1, but they may be located closely, or may be provided as a unit by adopting a touch panel.

Figure 2:
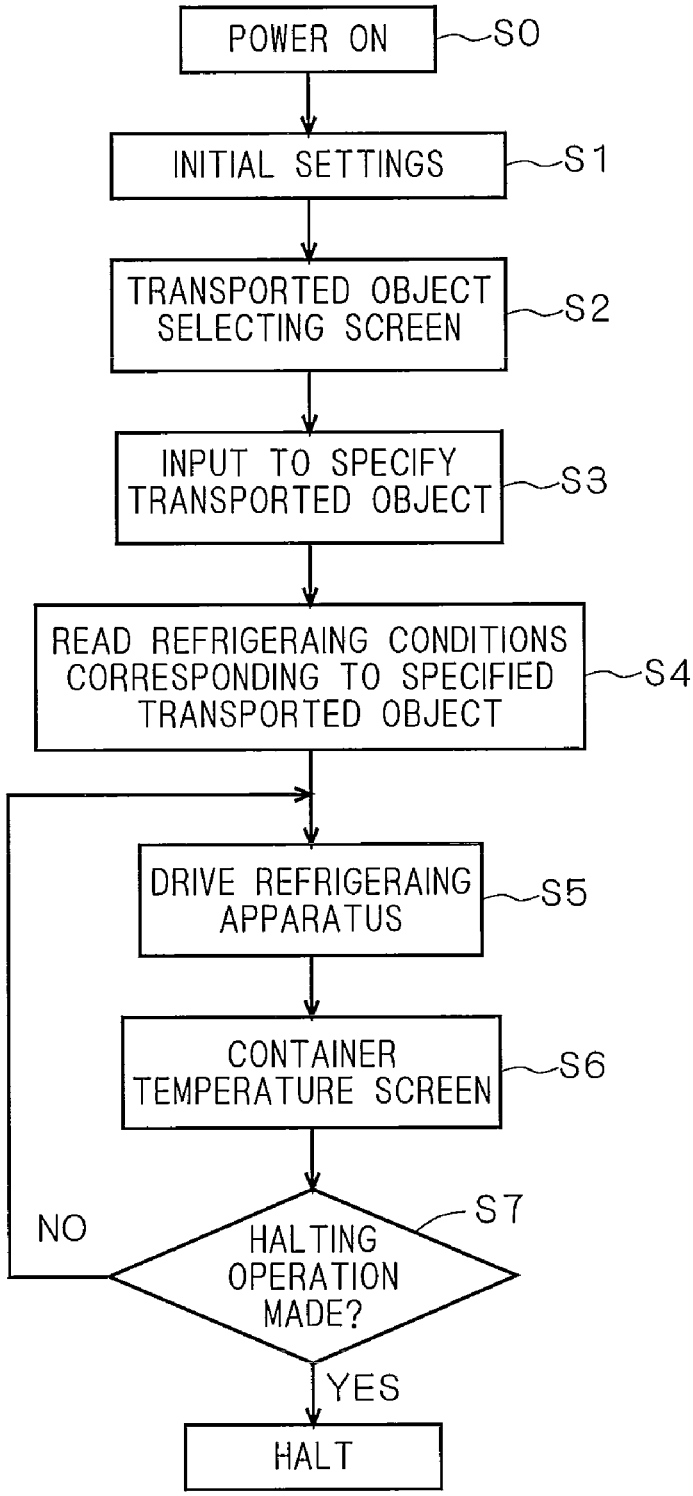
FIG. 2 is a flowchart illustrating the operation of the refrigerating system of this preferred embodiment.

FIG. 2 is a flowchart illustrating the operation of the refrigerating system of this preferred embodiment. First, when the power is turned on in Step S0, the refrigerating driving control section 11 makes initial settings of the refrigerating apparatus 3. The initial settings are known operations usually made, like checking the refrigerating apparatus 3 for abnormalities, and performing preparatory operation of the refrigerating apparatus 3 (e.g. preheating of the motor for driving the compressor). The initial settings are not described in detail herein because they are not directly related to the present invention.

Figure 3:
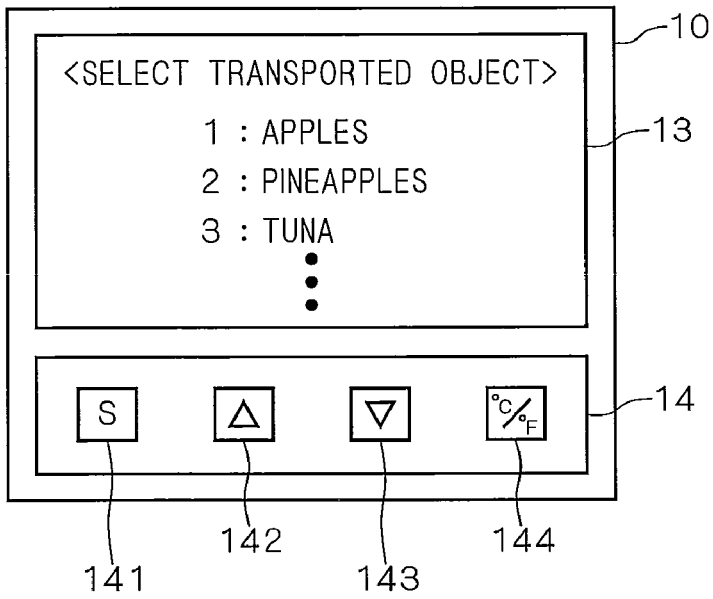
FIG. 3 is a conceptual diagram illustrating a display section displaying a screen for selecting an object to be transported.

Next, in Step S2, the display section 13 displays a transported object selecting screen for selecting the object to the transported. FIG. 3 is a conceptual diagram illustrating the display section 13 displaying a transported object selecting screen. This shows an example in which the operation section 14 is provided close to the display section 13 in a panel 10.

The transported object selecting screen displays a title "Select Transported Object", together with "1: Apples", "2: Pineapples", "3: Tuna", etc. The user operates the operation section 14 to select the kind of the object 4 stored in the refrigerated container 2.

For example, the operation section 14 has operating buttons 141, 142, 143 and 144. The operating button 141 (the button indicated as "S") is operated to offer a function of switching the transported object selecting screen and a container temperature screen display that displays container temperature (which will be described later). The operating buttons 142 and 143 (the buttons respectively indicated as "Δ" and "∇") have functions of respectively increasing and decreasing to specify items and numerical values displayed in the display section 13. The button 144 (the button indicated as "° C./° F.") is operated to offer a function of, when the transported object selecting screen is displayed, specifying the selected object 4 to cause the refrigerating driving control section 11 to recognize it. When a container temperature screen is displayed, it serves to switch the display of container temperature between Fahrenheit/Celsius.

In the transported object selecting screen, the operating buttons 142 and 143 are operated to select the object to be transported. The operating button 144 is then operated to specify the selected transported object (Step S3).

Then, in Step S4, the refrigerating driving control section 11 reads the refrigerating conditions corresponding to the specified transported object from the control constant storage section 12. Specifically, when the specified object 4 is tuna, the corresponding information L3 serves as a search key to search the data 120, and the control constants C3, D3, E3, . . . corresponding to the information L3 are read out.

Figure 4:
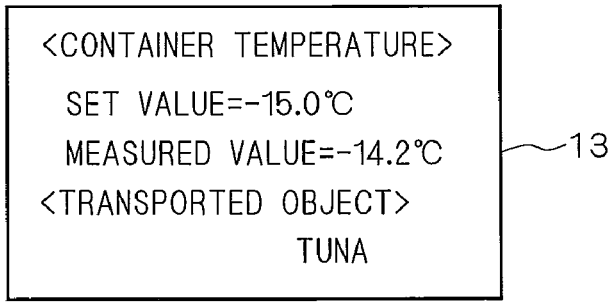
FIG. 4 is a conceptual diagram illustrating a display for container temperature.

Then, in Step S5, the refrigerating driving control section 11 controls the driving of the refrigerating apparatus 3 on the basis of the control constants C3, D3, E3 thus read out. Then, in Step S6, the display section 13 displays a container temperature display. FIG. 4 is a conceptual diagram illustrating the container temperature display, where a set value and a measured value are displayed. Displaying the specified object 4 (transported object) together as shown in the diagram is advantageous because the user can easily notice a misoperation. If the user notices a misoperation, the user can make halting operation to the control circuit 1. When such halting operation is not made in Step S7, Steps S5 and S6 are continuously carried out, and the operation halts when halting operation is made. This enables prompt measures to be taken when the user notices wrong specification in Step S3.

By adopting such a configuration and operating method, it is possible to suitably refrigerate the object 4 to be refrigerated by driving the refrigerating apparatus 3 under suitable refrigerating conditions just by specifying the refrigerated object 4 even when the user does not know detailed refrigerating conditions.

Needless to say, it is desired to store, in the control constant storage section 12 prior to Step S2, and for each object 4, data 120 where the information Li indicating an object 4 and the control constants Ci, Di, Ei, . . . adopted by the refrigerating driving control section 11 for the object 4 are associated together.

Figure 6:
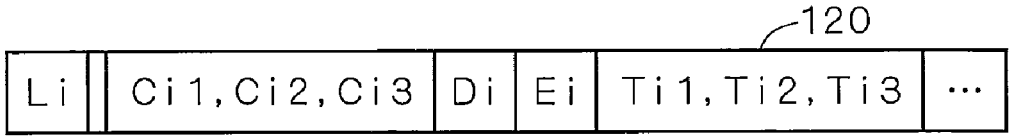
FIG. 6 is a diagram illustrating the structure of data stored in the control constant storage section.

For example, the control constant Ci adopted for the object 4 indicated by the information Li may take a plurality of temperature setting values. FIG. 6 is a diagram illustrating the structure of data 120 in such a case. The data 120 stores control constants Ci1, Ci2 and Ci3 and further stores control constants Ti1, Ti2 and Ti3.

The control constants Ci1, Ci2 and Ci3 determine a plurality of setting temperatures, and the control constants Ti1, Ti2 and Ti3 respectively determine the setting times that the setting temperatures determined by the control constants Ci1, Ci2 and Ci3 should last. For example, a setting temperature F1 determined by the control constant Ci1 is maintained for a setting time T1 determined by the control constant Ti1, and then a setting temperature F2 determined by the control constant Ci2 is maintained for a setting time $\tau$2 determined by the control constant Ti2, and then a setting temperature F3 determined by the control constant Ci3 is maintained for a setting time $\tau$3 determined by the control constant Ti3.

Figure 7:
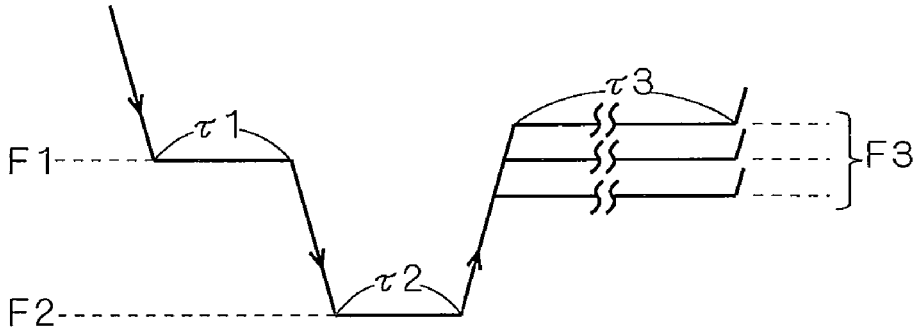
FIG. 7 is a graph illustrating a temperature variation in the refrigerated container.

FIG. 7 is a graph illustrating a temperature variation in the refrigerated container 2, where the setting temperatures F1 and F2 are set respectively in a chilled temperature zone (e.g. 2° C. below zero) and a frozen temperature zone (e.g. 18° C. below zero). The setting temperatures F1 and F2 are set to the temperatures shown above in order to confirm that the refrigerating apparatus 3 can make the refrigerated container 2 reach chilled temperature and frozen temperature.

The setting temperature F3 is set in a temperature zone that is suitable for the transportation of the object 4. FIG. 7 shows multiple kinds of objects 4 whose temperature zones suitable for transportation differ, and therefore a plurality of setting temperatures F3 are shown and the graph branches off.

Though it depends on the temperature suitable for the transportation of the object 4, when the quality of the object 4 does not deteriorate even when it is once refrigerated to the frozen temperature zone, the object 4 may be stored in the refrigerated container 2 before the setting temperature F2 is reached. Or, depending on the kind of the object 4, it may be stored in the refrigerated container 2 after the setting temperature F3 has been reached, or may be stored in the refrigerated container 2 before the setting temperature F1 is reached.

For example, when the temperature suitable for the transportation of the object 4 is in the frozen temperature zone, it is substantially unnecessary that the refrigerating apparatus 3 keep the refrigerated container 2 at chilled temperature. Accordingly, the setting time $\tau$1 corresponding to the kind of the object 4 can be set very short.

On the other hand, when the temperature suitable for the transportation of the object 4 is in the chilled temperature zone, it is substantially unnecessary that the refrigerating apparatus 3 keep the refrigerated container 2 at frozen temperature. Accordingly, the setting time $\tau$2 corresponding to the kind of the object 4 can be set very short. Alternatively, when the object 4 is of a kind that should not be brought to frozen temperature, the setting time $\tau$2 can be set at substantially zero, and the setting temperature F1 can be maintained for the setting time $\tau$1 and then the temperature can be immediately shifted to the setting temperature F3.

In the above-described example, the setting temperatures F1 and F2 are set respectively in a chilled temperature zone and a frozen temperature zone in order to confirm that the refrigerating apparatus 3 can make the refrigerated container 2 reach chilled temperature and frozen temperature. However, the setting temperatures F1 and F2 may be set respectively in a frozen temperature zone and a chilled temperature zone. Alternatively, not only the setting temperature F3 but also the setting temperatures F1 and F2 may be temperatures suitable for the transportation of the object 4, and the setting times $\tau$1 and $\tau$2 may be set corresponding to the transportation.

Also, the control constant Di adopted for the object 4 indicated by the information Li may take a plurality of humidity setting values Di1, Di2 and Di3. Also in this case, as in the case where the control constant Ci takes a plurality of temperature setting values, it is desired that the data 120 contain control constants Ti1, Ti2 and Ti3 that respectively determine the setting times that the setting humidity values determined by the control constants Di1, Di2 and Di3 should last.

However, it is not always necessary to store control constants Ti1, Ti2 and Ti3 for determining the setting times described above. This is because they can be controlled as default values when they are at fixed values.

While the invention has been described in detail, the foregoing description is in all aspects illustrative and not restrictive. It is understood that numerous other modifications and variations can be devised without departing from the scope of the invention.

The invention claimed is:

1. A refrigerating apparatus control circuit, comprising:

a refrigerating driving control section that controls driving of a refrigerating apparatus;

a control constant storage section that stores, for a plurality of objects, data in which information indicating an object to be refrigerated by said refrigerating apparatus and a control constant that said refrigerating driving control section adopts for that object are associated together; and an operation section that is operated to specify said object, wherein said refrigerating driving control section is configured to read from said control constant storage section said control constant corresponding to said object specified by said operation section, said control constant including a target temperature, said refrigerating driving control section is further configured to set a first target temperature warmer than the target temperature and drive said refrigerating apparatus to reach and maintain the first target temperature, said refrigerating driving control section is further configured to set a second target temperature colder than the target temperature and drive said refrigerating apparatus to reach and maintain the second target temperature, and said refrigerating driving control section is further configured to drive said refrigerating apparatus to reach and maintain the target temperature after having maintained the first target temperature and the second target temperature.

2. A refrigerating apparatus control circuit, comprising:

a refrigerating driving control section that controls driving of a refrigerating apparatus;

a control constant storage section that stores, for a plurality of objects, data in which information indicating an object to be refrigerated by said refrigerating apparatus and a control constant that said refrigerating driving control section adopts for that object are associated together; and an operation section that is operated to specify said object, wherein said refrigerating driving control section reads from said control constant storage section said control constant corresponding to said object specified by said operation section, and controls driving of said refrigerating apparatus on the basis of read said control constant, the refrigeration apparatus control circuit determines a plurality of setting temperatures, and second control constants determining a plurality of setting times that said setting temperatures should respectively last, and the driving of said refrigerating apparatus is controlled in correspondence with said object on the basis of said setting temperatures and said setting times.

3. The refrigerating apparatus control circuit according to claim 2, wherein, in each said data, a first of said plurality of setting temperatures is set in a chilled temperature zone, a second of said plurality of setting temperatures is set in a frozen temperature zone, and a third of said plurality of setting temperatures is set in a temperature zone that is suitable for transportation of said object to which that data corresponds.

4. The refrigerating apparatus control circuit according to claim 2, wherein, in each said data, said plurality of setting times are set corresponding to transportation of said object to which said data corresponds.

5. A refrigerating system comprising:

a refrigerating apparatus control circuit, including a refrigerating driving control section that controls driving of a refrigerating apparatus, a control constant storage section that stores, for a plurality of objects, data in which information indicating an object to be refrigerated by said refrigerating apparatus and a control constant that said refrigerating driving control section adopts for that object are associated together, and an operation section that is operated to specify said object, wherein said refrigerating driving control section is configured to read from said control constant storage section said control constant corresponding to said object specified by said operation section, said control constant including a target temperature, said refrigerating driving control section is further configured to set a first target temperature warmer than the target temperature and drive said refrigerating apparatus to reach and maintain the first target temperature, said refrigerating driving control section is further configured to set a second target temperature colder than the target temperature and drive said refrigerating apparatus to reach and maintain the second target temperature, and said refrigerating driving control section is further configured to drive said refrigerating apparatus to reach and maintain the target temperature after having maintained the first target temperature and the second target temperature; and said refrigerating apparatus.

6. The refrigerating system according to claim 5, further comprising a refrigerated container accommodating said refrigerating apparatus.

7. A refrigerating system, comprising:

a refrigerating apparatus control circuit including a refrigerating driving control section that controls driving of a refrigerating apparatus;

a control constant storage section that stores, for a plurality of objects, data in which information indicating an object to be refrigerated by said refrigerating apparatus and a control constant that said refrigerating driving control section adopts for that object are associated together; and an operation section that is operated to specify said object, wherein said refrigerating driving control section reads from said control constant storage section said control constant corresponding to said object specified by said operation section, and controls driving of said refrigerating apparatus on the basis of read said control constant, the refrigeration apparatus control circuit determines a plurality of setting temperatures, and second control constants determining a plurality of setting times that said setting temperatures should respectively last, and the driving of said refrigerating apparatus is controlled in correspondence with said object on the basis of said setting temperatures and said setting times; and said refrigerating apparatus.

8. A refrigerating system according to claim 7, wherein, in each said data, a first of said plurality of setting temperatures is set in a chilled temperature zone, a second of said plurality of setting temperatures is set in a frozen temperature zone, and a third of said plurality of setting temperatures is set in a temperature zone that is suitable for transportation of said object to which that data corresponds.

9. A refrigerating system according to claim 7, wherein, in each said data, said plurality of setting times are set corresponding to transportation of said object to which said data corresponds.

10. A refrigerating apparatus control method, comprising:

displaying a plurality of objects to be refrigerated by a refrigerating apparatus;

inputting to specify one of said objects;

reading, from a control constant storage section, a control constant that corresponds to said one of said objects specified in said inputting and that is adopted to control driving of said refrigerating apparatus, said control constant including a target temperature;

setting a first target temperature warmer than the target temperature;

driving the refrigerating apparatus to reach the first target temperature;

maintaining the first target temperature for a first period of time;

setting a second target temperature colder than the target temperature;

driving the refrigerating apparatus to reach the second target temperature;

maintaining the second target temperature for a second period of time;

and controlling the driving of said refrigerating apparatus to reach and maintain the target temperature after having maintained the first target temperature and the second target temperature.

11. The refrigerating apparatus control method according to claim 10, further comprising:

storing in said control constant storage section, for each said object, data in which information indicating an object and a control constant that said refrigerating driving control section adopts for that object are associated together.

12. A refrigerating apparatus control method, comprising:

displaying a plurality of objects to be refrigerated by a refrigerating apparatus;

inputting to specify one of said objects;

reading, from a control constant storage section that stores, for a plurality of objects, data in which information indicating an object to be refrigerated by said refrigerating apparatus and a control constant for the specified object are associated together, a control constant that corresponds to said one of said objects specified in said inputting and that is adopted to control driving of said refrigerating apparatus; and controlling the driving of said refrigerating apparatus on the basis of said control constant read in said reading, wherein said control constant has first control constants determining a plurality of setting temperatures, and second control constants determining a plurality of setting times that said setting temperatures should respectively last, and in said controlling the driving, the driving of said refrigerating apparatus is controlled in correspondence with said object on the basis of said setting temperatures and said setting times.

13. The refrigerating apparatus control method according to claim 12, wherein, in each said data, a first of said plurality of setting temperatures is set in a chilled temperature zone, a second of said plurality of setting temperatures is set in a frozen temperature zone, and a third of said plurality of setting temperatures is set in a temperature zone that is suitable for transportation of said object to which that data corresponds.

14. The refrigerating apparatus control method according to claim 13, further comprising:

storing in said control constant storage section, and for each said object, data in which information indicating an object and a control constant that said refrigerating driving control section adopts for that object are associated together.

15. The refrigerating apparatus control method according to claim 12, wherein, in each said data, said plurality of setting times are set corresponding to transportation of said object to which said data corresponds.

16. The refrigerating apparatus control method according to claim 15, further comprising:

storing in said control constant storage section, and for each said object, data in which information indicating an object and a control constant that said refrigerating driving control section adopts for that object are associated together.

17. The refrigerating apparatus control method according to claim 12, further comprising:

storing in said control constant storage section, and for each said object, data in which information indicating an object and a control constant that said refrigerating driving control section adopts for that object are associated together.

* * * * *